US007160205B2

(12) United States Patent
Yamamoto

(10) Patent No.: US 7,160,205 B2
(45) Date of Patent: Jan. 9, 2007

(54) GOLF CLUB HEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/621,526

(22) Filed: Jul. 18, 2003

(65) Prior Publication Data

US 2004/0018889 A1 Jan. 29, 2004

(30) Foreign Application Priority Data

Jul. 23, 2002 (JP) ..... 2002-214190

(51) Int. Cl.
*A63B 53/04* (2006.01)

(52) U.S. Cl. ..... 473/345; 473/324

(58) Field of Classification Search ..... 473/324, 473/340, 345, 344

See application file for complete search history.

(56) References Cited

U.S. PATENT DOCUMENTS 5,255,918 A * 10/1993 Anderson et al. ..... 473/330
6,325,728 B1 * 12/2001 Helmstetter et al. ..... 473/328
6,340,337 B1 * 1/2002 Hasebe et al. ..... 473/349
6,406,378 B1 * 6/2002 Murphy et al. ..... 473/224
6,592,466 B1 * 7/2003 Helmstetter et al. ..... 473/224
6,659,885 B1 * 12/2003 Knuth ..... 473/329

FOREIGN PATENT DOCUMENTS

| | | | |
|---|---|---|---|
| JP | 10-24128 A | | 1/1998 |
| JP | 10-33724 A | | 2/1998 |
| JP | 10-179819 A | | 7/1998 |
| JP | 10-179820 A | | 7/1998 |
| JP | 11155982 A | * | 6/1999 |
| JP | 2001-87426 A | | 4/2001 |

* cited by examiner

*Primary Examiner*—Eugene Kim
*Assistant Examiner*—Alvin A. Hunter, Jr.
(74) *Attorney, Agent, or Firm*—Birch,Stewart,Kolasch & Birch,LLP

(57) ABSTRACT

A golf club head whose head volume is in a range of from 355 to 450 cc comprises a hollow body comprising a face portion and sole portion each made of a metal material, and the hollow body has a structure producing a ball-hitting sound whose maximum sound pressure level occurs around 6.3 kHz.

4 Claims, 5 Drawing Sheets

GOLF CLUB HEAD

BACKGROUND OF THE INVENTION

The present invention relates to a golf club head, more particularly to a large-sized hollow metal head having a structure being capable of shifting the sound spectrum of ball hitting sounds towards higher frequency.

In recent years, metal wood-type golf club heads are remarkably increased in size to improve ball-hitting performance, e.g. rebound performance, carry, directional stability and the like, and the head volume reaches to over 450 cc. In such a very large-sized metal head, accordingly, in order to prevent the weight from increasing, the head is formed as being hollow, and the thickness of metal material is minimized in various portions including the sole portion. As a result, the ball-hitting sound has a tendency to lower its pitch as the head volume increases although a clear high pitch sound is preferred by many golfers. Thus, there is a great demand for club heads improved in not only the hitting performance but also the ball-hitting sounds. Such demand is especially strong in the metal wood-type golf club heads.

SUMMARY OF THE INVENTION

It is therefore an object of the present invention to provide a golf club head which can produce ball hitting sounds whose maximum sound pressure level occurs at a relatively high frequency in spite of the large head volume 355 to 450 cc.

According to present invention, a golf club head having a head volume in a range of from 355 to 450 cc comprises a hollow body comprising a face portion and sole portion each made of a metal material, and the hollow body has a structure producing a ball-hitting sound whose maximum sound pressure level occurs around 6.3 kHz.

BRIEF DESCRIPTION OF THE DRAWINGS

FIG. 5(*b*) is a cross-sectional view of another example of the sole portion.

DESCRIPTION OF THE PREFERRED EMBODIMENTS

Figure 1:
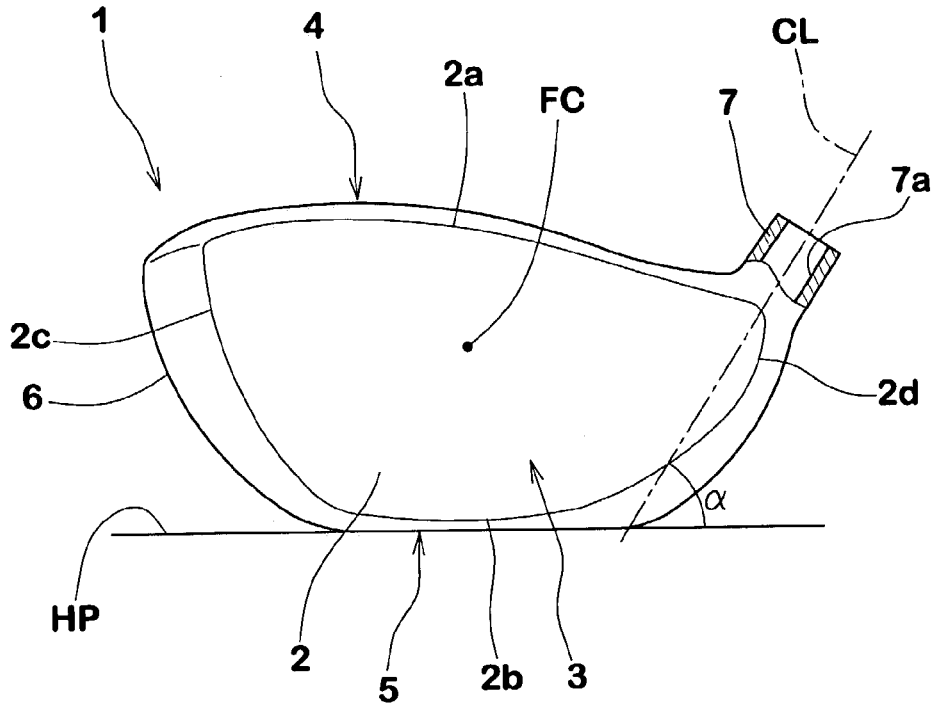
FIG. 1 is a front view of a golf club head according to the present invention.

Embodiments of the present invention will now be described in detail in conjunction with the accompanying drawings.

In the drawings, golf club head 1 according to the present invention is a wood-type hollow club head which comprises

- a face portion 3 having an outer surface defining a club face 2 for hitting a golf ball,
- a crown portion 4 extending from the upper edge 2*a* of the club face 2 and defining an upper surface of the head,
- a sole portion 5 extending from the lower edge 2*b* of the club face 2 and defining a bottom surface of the head,
- a side portion 6 between the crown portion 4 and sole portion 5 extending from the toe side edge 2*c* to the heel side edge 2*d* of the club face 2 through the back face of the head, and
- a hosel portion 7 attached to the end of a club shaft (not shown).

The hosel portion 7 is formed near the heel side intersection of the face portion 3, crown portion 4 and side portion 6, and provided with a shaft inserting hole 7*a*. The shaft inserting hole 7*a* has an opening for the club shaft at the top of the hosel portion 7, and extends through a tubular part which part extending into the hollow.

Figure 2:
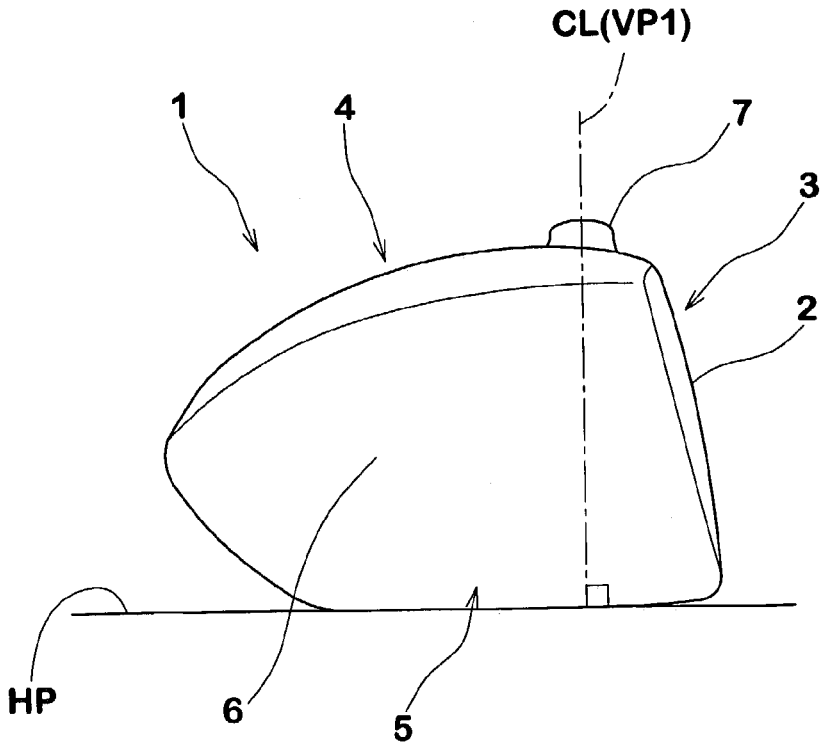
FIG. 2 is a left side view thereof.
Figure 3:
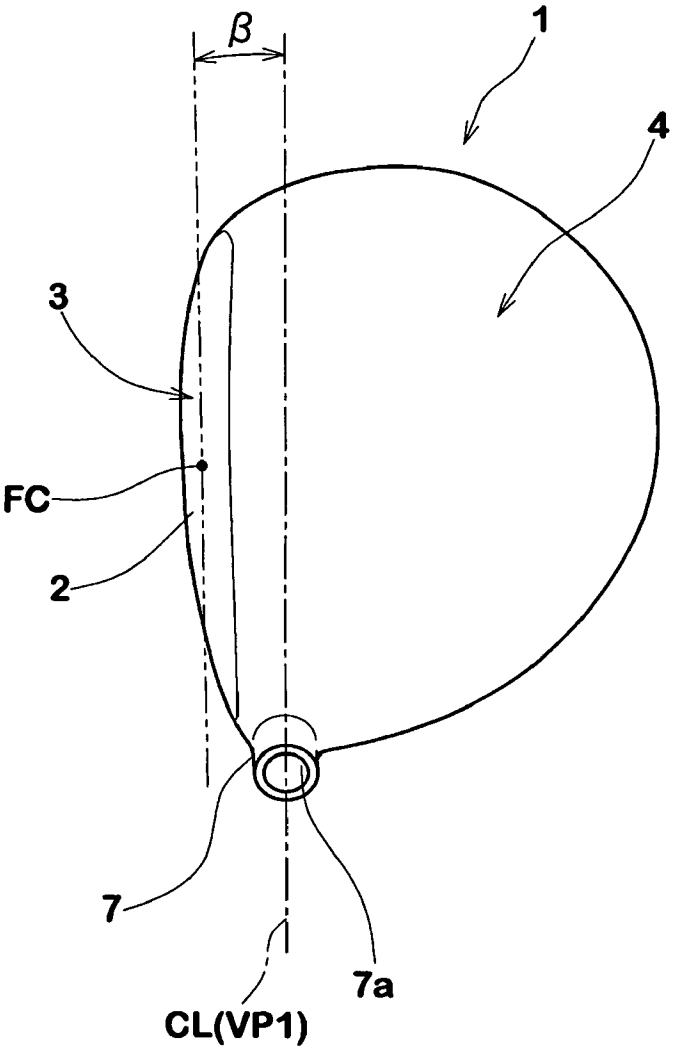
FIG. 3 is a top view thereof.

In FIGS. 1, 2, 3, 4, 5 and 6, the golf club head 1 is put on a horizontal plane HP with its lie angle alpha and face angle beta specified therefor (hereinafter, the "measuring state" of the head). More specifically, in the measuring state, as shown in FIGS. 1 and 2, the central axis CL of the club shaft or the center line of the club shaft inserting hole 7*a* is inclined at the lie angle alpha with respect to the horizontal plane HP within a vertical plane (hereinafter, the "first vertical plane VP"), and as shown in FIG. 3, a horizontal line N tangent to the centroid FC of the club face forms the face angle beta with respect to the first vertical plane VP1.

The volume of the club head 1 inclusive of that of the shaft inserting hole and coating if any is in a range of from 355 to 450 cc, namely, the present invention can be suitably applied to heads having such volume. But, in view of the durability, rebound performance, production efficiency and cost and the like, it will be preferable that the head volume is set in the range of 380 to 430 cc, more preferably 400 to 420 cc in case of the following embodiments.

According to the present invention, the club head is constructed to produce hitting sounds whose sound pressure level spectrum shows the maximum sound pressure level in dB(A) around a frequency of 6.3 kHz and the level thereof is preferably in a range of 105 to 115 dB(A), more preferably 107 to 115 dB(A), still more preferably 110 to 115 dB(A) when measured under the undermerntioned condition.

In this embodiment, the club head 1 is a driver (#1 wood).

The club head 1 comprises two or more metallic parts which are each formed by a method suitable for the material, e.g. lost-wax precision casting, forging, pressing or the like, and these metallic parts are joined together for example by welding, caulking, adhesive agent and the like.

To make the above-mentioned metallic parts, at least one kind of metallic material, e.g. titanium alloys, pure titanium, stainless steels, aluminum alloys and the like is used.

In this embodiment, the head 1 is composed of an open-front hollow main body and a face plate attached to the front of the main body closing the front opening. The main body is a lost-wax precision casting of a titanium alloy (Ti-6Al-4V), and the face plate is made of the same titanium alloy and formed by press molding. These parts are welded together.

The hollow or inside of the head is void in this example, but it may be filled with a filler such as foamed resin as a whole or in part thereof.

In order to produce the above-mentioned relatively high pitch tone hitting sounds in the large-sized hollow head, firstly it is necessary to improve the thickness distribution and shape of the sole portion 5.

When the head volume is increased over 355 cc, as the sole portion 5 becomes broader and flatter as a necessary consequence, the sole portion 5 becomes liable to vibrate like a soundboard and the natural vibration frequency becomes lower as the surface area becomes broader and the sole portion 5 becomes flatter. On the other hand, the front edge of the sole portion 5 is directly connected to the face portion 3 which receives a large impact force when hitting a ball.

Thus, the vibration of the sole portion 5 is the main factor of lowering the frequency at which the maximum sound pressure level occurs (hereinafter, the "peak frequency").

In the present invention, therefore, in order to shift the peak frequency towards the preferred higher frequency band, the rigidity distribution is specifically defined by arranging the thickness distribution and surface area.

Figure 5A:
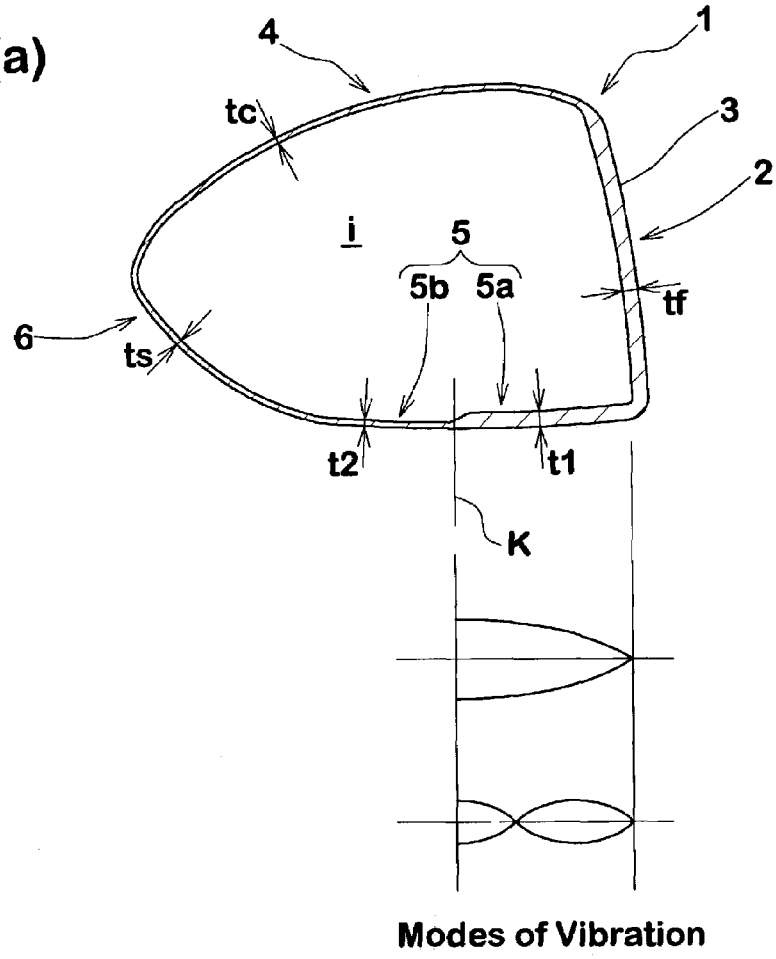
FIG. 5(*a*) is a cross-sectional view thereof taken along a vertical plane including the centroid of the club face and being perpendicular to the undermentioned first vertical plane VP1.
Figure 5B:
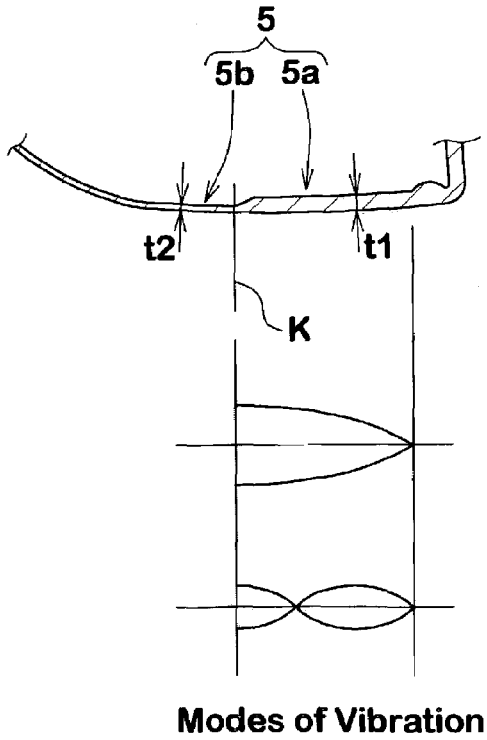

In this embodiment, the sole portion 5 comprises a thicker front part 5*a* and a relatively thin back part 5*b* situated next thereto. In FIG. 5(*a*), the thicker part 5*a* is formed immediately inside the face portion 3. But, as shown in FIG. 5(*b*), if the formation of a thick weld run is inevitable, the thicker part 5*a* is formed immediately inside such weld run as shown in FIG. 5(*b*). In any case, the thickness t1 of the front part 5*a* is set in a range of from 1.2 to 1.8 mm, preferably 1.4 to 1.6 mm. The thickness t2 of the back part 5*b* is set in a range of from 0.7 to 1.8 mm, preferably 0.9 to 1.6 mm.

The ratio (t2*a*/t1*a*) of the average thickness t2*a* (mm) of the back part 5*b* to the average thickness t1*a* (mm) of the front part 5*a* is set in a range of less than 1, but preferably not less than 0.5, more preferably not less than 0.8.

Here, the average thickness means the area weighted average thickness ta. Given that the objective part is made up of small regions i (i=1, 2 - - - n) each having a thickness ti and area Si, the average thickness ta (t1*a*, t2*a*) is $$ta = \sum_{i=1}^{n} (ti \times Si) \Big/ \sum_{i=1}^{n} Si \quad (i = 1, 2 \ldots n)$$

Thus, the average thickness may be regarded as the volume of the objective part divided by the total area (σSi).

As a result, in the back and forth direction of the head, modes of the vibrations of the sole portion 5 become close to those on the assumption that the rear edge of the front part 5*a* is a free end and the front edge is a fixed end as shown in FIGS. 5(*a*) and 5(*b*). Accordingly, the peak frequency is increased when compared with the front part 5*a* which is made in the same thickness as the back part. The preferable position of the rear edge K of the thick front part 5*a* may be varied to some extent, depending on the material, shape (size) of the sole portion 5. But, mostly, it may be preferable that the rear edge K (K1, K2, K3) is positioned at around the midpoint of the length Ls of the sole portion 5 in the back and forth direction.

Figure 4:
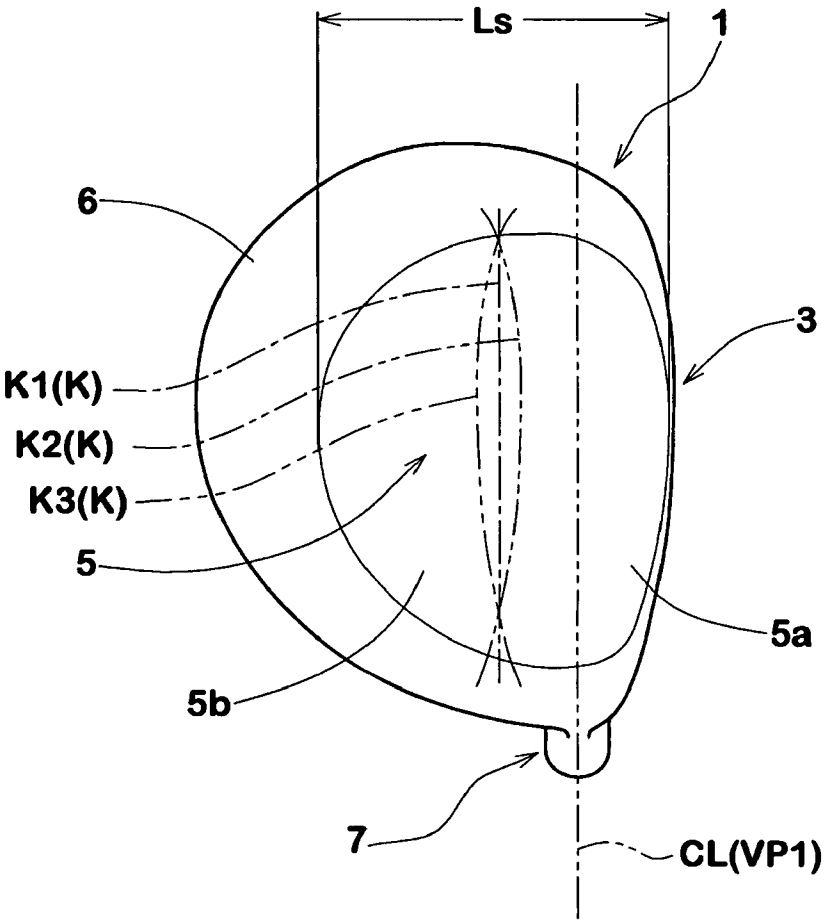
FIG. 4 is a bottom view thereof.

In this embodiment, the thick front part 5*a* and thin back part 5*b* extend from the toe-side edge to the heel-side edge of the sole portion 5. The rear edge K is substantially straight and substantially parallel with the above-mentioned first vertical plane VP1 when viewed from the upside or underside as shown in FIG. 4 by a single-dashed line K1. But, it is also possible t6 curve the rear edge K concavely in parallel with the clubface as indicated by a double-dashed line K2 or convexly as indicated by a triple-dashed line K3. When curved concavely (K2), a certain frequency may be enhanced. But, when curved convexly (K3), the sound spectrum may be dispersed. When straight (K1), the sound spectrum will take a middle position. In any case, the thickness decreasing from t1*a* to t2*a* is concentrated on such a straight or curved line so that the antinode of the vibrations occurs along this line.

In this embodiment, furthermore, the sole portion 5 is made smaller in the surface area than that of the conventional club heads, whereby the natural vibration frequency of the sole portion 5 as whole may be increased. Preferably, the surface area is set in a range of from 4000 to 5500 sq·mm, more preferably 4500 to 5000 sq·mm.

The decreasing of the surface area of the sole portion 5 will necessitate the side portion 6 being inclined at a larger angle, and the intersecting angle between the sole portion 5 and the side portion 6 becomes increased. As a result, the edge or the border therebetween is liable to become vague.

Figure 6:
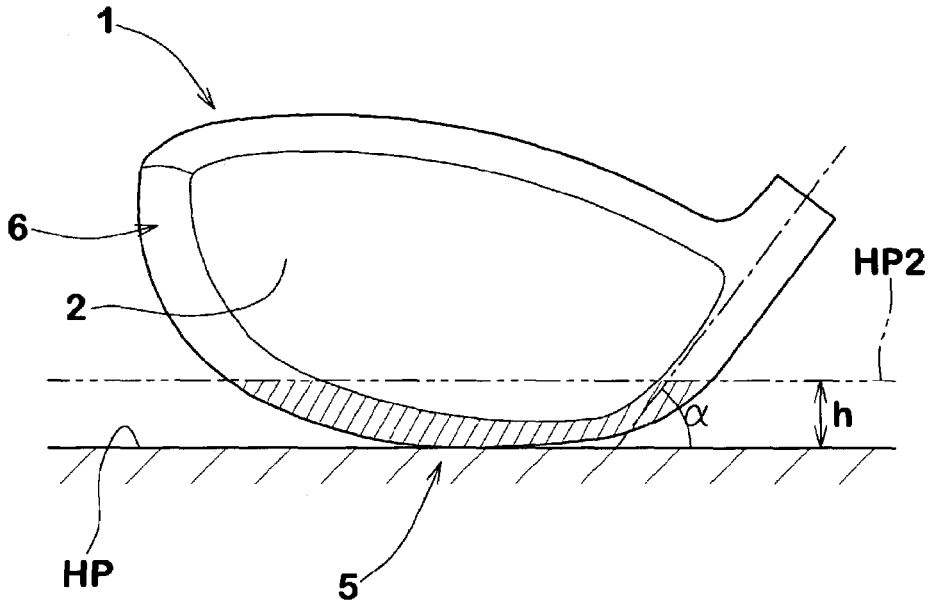
FIG. 6 is the front view of another golf club head for explaining the definition of the surface of the sole portion.

Further, when the edge portion between the sole portion 5 and side portion 6 is rounded or formed by a curved surface as shown in FIG. 6 (such a configuration is usually and preferably employed in the large-sized wood-type golf club heads), the border becomes more vague. Therefore, if the border is unclear, the sole portion 5 is defined as a portion under a height h of 8 mm from the horizontal plane HP under the above-mentioned measuring state.

As to the thicknesses of the other portions, on the other hand, if the thickness tf of the face portion 3 is too large, it is difficult to improve the rebound performance. On the contrary, if the thickness tf is too small, as the flexural deformation accompanying relatively low frequency vibrations increases, the peak frequency tends to shift towards the lower frequency. Further, the durability may be reduced. Therefore, the thickness tf of the face portion 3 is preferably set in a range of from 2.0 to 3.5 mm, more preferably 2.6 to 3.2 mm.

As to the crown portion 4, if the thickness tc thereof is too large, as the gravity point of the club head becomes high, it may be difficult for the user to control or handle the golf club. On the contrary, if too small, it is not preferable in view of the durability. Therefore, the thickness tc is preferably set in the range of from 0.4 to 1.5 mm, more preferably 0.7 to 1.2 mm.

Further, the thickness ts of the side portion 6 is preferably set in a range of from 0.8 to 1.5 mm, more preferably 0.8 to 1.2 mm. If the side portion 6 is too thin, the durability decreases. If too thick, the sweet spot position tends to become high, and the design freedom is liable to be restricted.

Comparison Tests

Golf club heads having the specification given in Table 1 were made and the following comparison tests were conducted. Each of the heads was formed by welding together a face plate corresponding to the face portion and a main body corresponding to the remaining portions, wherein the main body was a lost-wax precision casting of a titanium alloy Ti-6AI-4V, and the face plate was also made of Ti-6AI-4V and formed by press molding. Each of the heads was attached to an identical shaft made of a carbon-fiber reinforced resin to make a 45-inch wood club.

(1) Durability Test

The golf club was mounted on a swing robot, and struck golf balls 3000 times at the head speed of 50 meter/second.

Thereafter, the club face was checked for deformation and/or damage. The test results are shown as Durability in Table 1.

Figure 8:
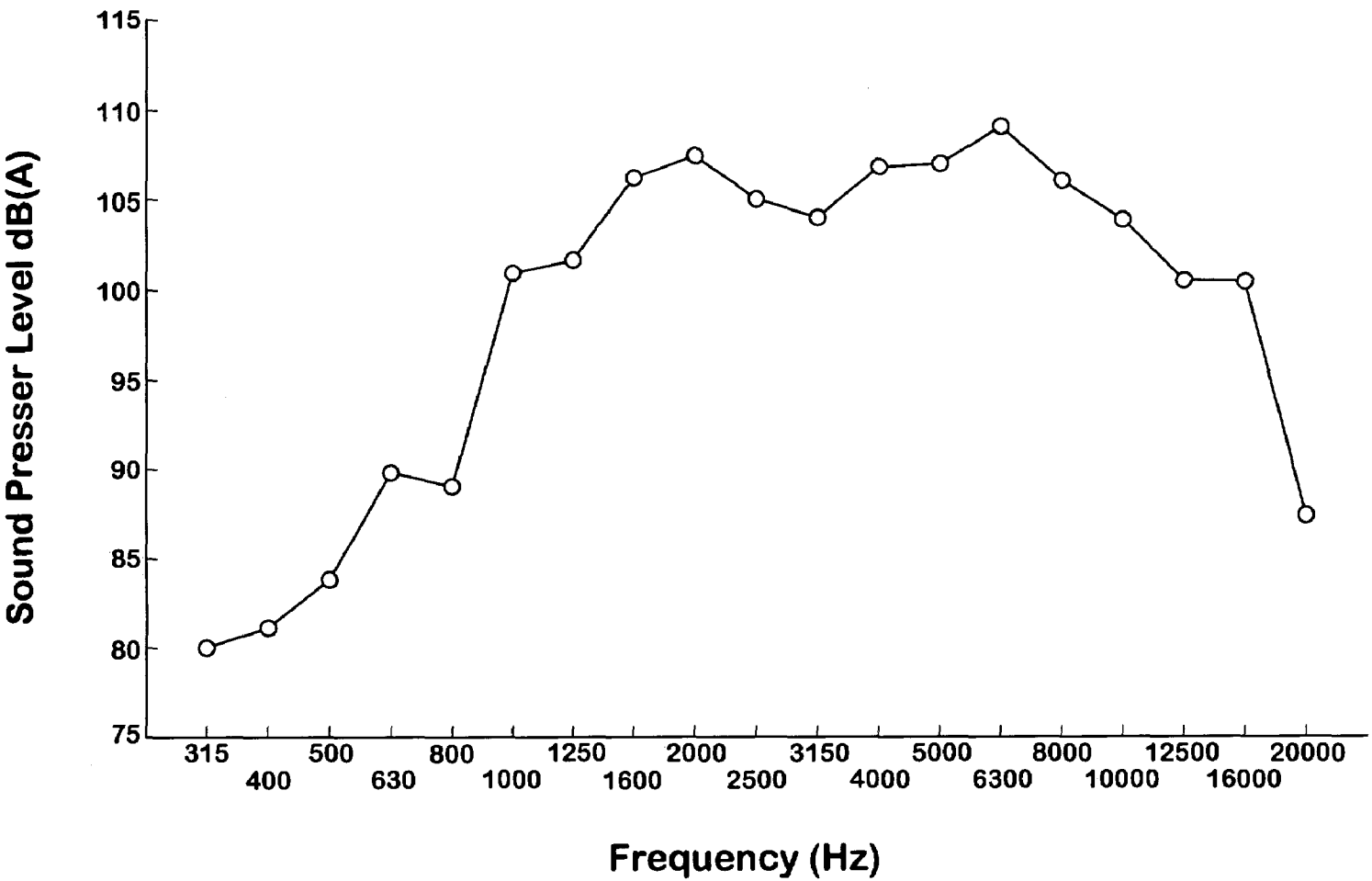
FIG. 8 is a sound spectrum graph of amplitude in decibels versus frequency in hertz of the hitting sound of a golf club head according to the present invention.

The sound spectrum obtained as a result of the ⅓ octave analysis of the hitting sound of Ex. 2 head is shown in FIG. 8. As to the other heads, only the peak frequency and sound pressure level are shown in Table 1.

TABLE 1

| Club Head | Ref. 1 | Ref. 2 | Ex. 1 | Ex. 2 | Ex. 3 | Ref. 3 | Ex. 4 | Ex. 5 | Ex. 6 |
|---|---|---|---|---|---|---|---|---|---|
| Head volume (cc) | 360 | 380 | 360 | 360 | 380 | 360 | 400 | 450 | 360 |
| Thickness | | | | | | | | | |
| Face portion tf (mm) | 2.8 | 2.5 | 2.8 | 2.7 | 2.8 | 2.8 | 2.8 | 2.8 | 2.8 |
| Crown portion tc (mm) | 1.3 | 0.8 | 0.9 | 0.8 | 1.1 | 0.9 | 0.9 | 0.9 | 0.9 |
| Side portion ts (mm) | 1.1 | 0.8 | 1 | 0.9 | 1.1 | 1 | 1 | 1 | 1 |
| Sole front part (ave.) t1a (mm) | 1 | 2 | 1.5 | 1.8 | 1.2 | 1.5 | 1.5 | 1.2 | 1.5 |
| Sole back part (ave.) t2a (mm) | 1 | 2 | 1.5 | 1.8 | 1.2 | 1.5 | 1 | 0.7 | 1.5 |
| Sole surface area (sq.mm) | 5500 | 5500 | 5500 | 5500 | 5500 | 6500 | 5500 | 5500 | 4500 |
| Test results | | | | | | | | | |
| Durability *1 | A | B | A | A | A | A | A | A | A |
| Hitting sound | | | | | | | | | |
| Peak frequency in kHz | 4 | 8 | 6.3 | 6.3 | 6.3 | 4 | 6.3 | 6.3 | 6.3 |
| Sound Pressure Level in dB(A) | 99 | 109 | 107 | 109 | 105 | 107 | 110 | 113 | 104 |
| Feeling Evaluation | 3.8 | 3.9 | 4.5 | 4.7 | 4.4 | 3.8 | 4.7 | 4.8 | 4.3 |

*1) A: not damaged, B: damaged (2) Hitting Sound Test (Feeling Test)

The hitting sound of each golf club was evaluated into five ranks in view of clearness and pleasantness by ten golfers (male: 7, female: 3) having handicaps ranging from 10 to 25. The test results are shown in Table 1, wherein the higher the rank number, the better the hitting sound.

(3) Hitting Sound Test (⅓ Octave Analysis)

Figure 7:
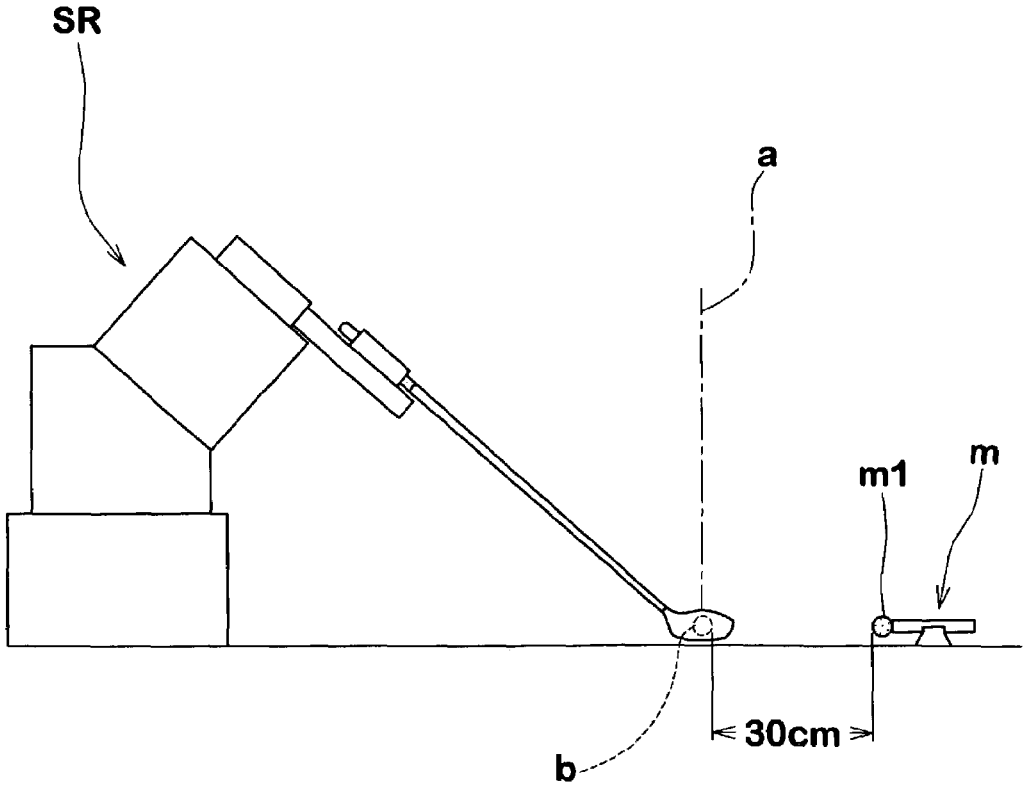
FIG. 7 is a diagram for explaining the method of measuring the hitting sounds.

To obtain the sound pressure spectrum, the hitting sound was picked up using a microphone ml fixed at a distance of 30 cm from the golf ball as shown in FIG. 7.

In order to carryout the hitting test under the same constant conditions, the swing robot SR was used, and the golf club struck a golf ball at the center of the club face at the head speed of 40 meter/second. The golf balls used were a solid ball with an ionomer resin cover conforming to the tournament rules.

The position of the microphone m1 was opposite to the swing robot (or golfer) with respect to position of the ball (b), and the height of the microphone m1 was the same as the ball (b). As mentioned above, the distance between the microphone m1 and golf ball was set to 30 cm in order to cut noises.

The microphone m1 used was that of a sound level meter (m), and the picked-up sound was A-weighted using the A-weighing network integrated in the sound level meter (m). Then, under the following conditions, the A-weighted analog output signal was sampled using a sampler (Graduo DS2000 manufactured by Ono sokki Co., Ltd.) and ⅓ octave analysis was performed on the sampled data using a computer and a FET frequency analyzing software (of Graduo DS2000).

Calibration for sound level meter: 250 Hz (124 dB)

Sampling time period: 0 to 48 ms from the time of hitting the golf ball

Number of sampled data: 2048

Power spectrum range: 0 to 20 kHz

⅓ Octave band center frequencies: 12.5, 16, 20, 25, 31, 40, 50, 63, 80, 100, 125, 160, 200, 250, 315, 400, 500, 630, 800, 1 k, 1.25 k, 1.6 k, 2 k, 2.5 k, 3.15 k, 4 k, 5 k, 6.3 k, 8 k, 10 k, 12.5 k, 16 k, 20 k HZ Form the test results, it was confirmed that the golf club heads Ex. 1–Ex. 6 according to the present invention show the peak frequency in the 6.3 kHz band, and those golf club heads were also highly evaluated by the golfers. Thus, the correlation between the high evaluation and peak frequency in the 6.3 kHz band was also proved. Further, in the hitting sound test, the testers could not feel the heightened peak frequency if the sound pressure level of the 6.3 kHz band was under 105 dB(A) because it was masked by the sound of other frequency bands. If the sound pressure level of the 6.3 kHz band is over 115 dB(A), the hitting sound was felt too loud.

As to the peak frequency around 6.3 kHz, as well known in the art, each of the ⅓ Octave bands has a certain bandwidth. Therefore, if the 6300 Hz band shows the maximum sound pressure level, it is not always equal to the frequency at which actually the maximum sound pressure level occurs, which may be more accurately determined by decreasing the bandwidths. This is the reason for using the term "around 6.3 kHz".

The invention claimed is:

1. A golf club head having a head volume in a range of from 355 to 450 cc and comprising a hollow body comprising a face portion and sole portion each made of a metal material, the hollow body having a structure producing a ball-hitting sound whose maximum sound pressure level occurs around 6.3 kHz, said structure including:

said sole portion comprising a front part and a back part next to the front part, wherein the front part is thicker than the back part and has a substantially constant thickness of from 1.2 to 1.8 mm, and the decrease in the thickness of the sole portion from that of the front part to that of the back part concentrates near the rear edge of the front part; and the surface area of the sole portion being in a range of from 4000 to 5500 $mm^2$, and the front part has a rear edge (K) that is curved convexly toward the club face.

2. A golf club head according to claim 1, wherein the thickness of the back part is from 0.7 to 1.8 mm.

3. The golf club head according to claim 2, in which the front part has a rear edge (K) that is positioned in the middle of the length (LS) of the sole portion in the front-to-back direction.

4. A golf club head having a head volume in a range of from 355 to 450 cc and comprising a hollow body comprising a face portion and sole portion each made of a metal material, said sole portion comprising a front part and a back part next to the front part, wherein said front part is thicker than the back part, the decrease in the thickness of the sole portion from that of the front part to that of the back part concentrates near the rear edge of the front part, and said rear edge is curved convexly toward the club face, said front part has a substantially constant thickness of from 1.2 to 1.8 mm, said back part has a thickness of from 0.7 to 1.8 mm, and the ratio of the thickness of the back part to the thickness of the front part is greater than 0.5 but less than 1, the surface area of the sole portion is in a range of from 4000 to 5500 $mm^2$.

* * * * *